US009281646B2

(12) United States Patent
Chen

(10) Patent No.: US 9,281,646 B2
(45) Date of Patent: Mar. 8, 2016

(54) ELECTRICAL CONNECTOR WITH ADDITIONAL POWER TERMINALS

(71) Applicant: HON HAI PRECISION INDUSTRY CO., LTD., New Taipei (TW)

(72) Inventor: De-Jin Chen, ShenZhen (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/271,466

(22) Filed: May 7, 2014

(65) Prior Publication Data

US 2014/0335738 A1 Nov. 13, 2014

(30) Foreign Application Priority Data

May 7, 2013 (CN) ..... 2013 2 02406699

(51) Int. Cl.

| | |
|---|---|
| ***H01R 24/00*** | (2011.01) |
| ***H01R 33/00*** | (2006.01) |
| ***H01R 27/00*** | (2006.01) |
| ***H01R 24/60*** | (2011.01) |
| *H01R 107/00* | (2006.01) |

(52) U.S. Cl.
CPC ..... *H01R 27/00* (2013.01); *H01R 24/60* (2013.01); *H01R 2107/00* (2013.01)

(58) Field of Classification Search
CPC ..... H01R 24/76; H01R 23/7073; H01R 23/7068; H01R 12/57
USPC ..... 439/660, 629, 79, 83
See application file for complete search history.

(56) References Cited

U.S. PATENT DOCUMENTS

| | | | | |
|---|---|---|---|---|
| 6,743,060 | B2 * | 6/2004 | Wu | 439/741 |
| 7,559,805 | B1 * | 7/2009 | Yi et al. | 439/660 |
| 7,727,028 | B1 * | 6/2010 | Zhang et al. | 439/660 |
| 8,052,479 | B1 * | 11/2011 | Zhu | 439/660 |
| 8,100,718 | B2 * | 1/2012 | Li et al. | 439/607.01 |
| 2011/0294354 | A1 * | 12/2011 | Chen et al. | 439/660 |

* cited by examiner

*Primary Examiner* — Hae Moon Hyeon
(74) *Attorney, Agent, or Firm* — Wei Te Chung; Ming Chieh Chang

(57) ABSTRACT

An electrical connector comprises an insulative housing and a plurality of first conductive terminals retained in the insulative housing. The insulative housing defines a mating frame running through a front face thereof. An L-shaped mating tongue extends forwardly in the mating frame. The mating frame has two opposite inner surfaces facing to the mating tongue and spaced from the mating tongue. The first conductive terminal each includes a contacting portion arranged on a mating face of the mating tongue and a connecting portion extending out of the insulative housing. The electrical connector includes second conductive terminals disposed on both inner surface of the mating frame. The second conductive terminals are used for different-voltage power transmission. Therefore, the electrical connector not only meets the specification of SATA connector, but also provides the function of signal transmission and different-voltage power transmission.

17 Claims, 4 Drawing Sheets

ELECTRICAL CONNECTOR WITH ADDITIONAL POWER TERMINALS

BACKGROUND OF THE INVENTION

1. Field of the Invention

The present invention generally relates to an electrical connector, and more particularly to an electrical connector connected to a complementary connector.

2. Description of Related Art

Typically, Serial ATA (Serial Advanced Technology Attachment, based on industry-standard hardware serial drive interface) electrical connector includes an L-shaped tongue with seven conductive terminals arranged upon a mating face thereof.

However, the seven conductive terminals arranged in the L-shaped tongue are used for transmitting differential signals, and the connector does not have any additional power contact for power supply.

In view of the foregoing, an electrical connector with additional contacts for power supply would be desirable.

SUMMARY OF THE INVENTION

Accordingly, an object of the present invention is to provide an electrical connector which can provide not only the differential pairs transmission but also the different-voltage power transmission.

In order to achieve the object set forth, an electrical connector comprising an insulative housing, a plurality of first conductive terminals and a pair of second conductive terminals retained in the insulative housing. The insulative housing defines a mating tongue and a mating frame formed around the mating tongue. The mating frame defines a mating cavity miming through a front face thereof, and the mating tongue disposed in the mating cavity to be surrounded by the mating frame. Said mating frame defines two opposite sidewalls perpendicular to the mating face, each sidewall defines an inner surface facing to the mating tongue and spaced from the mating tongue. The first conductive terminals provide first contacting portions exposed upon a mating face of the mating tongue. The pair of second conductive terminals each provides a second contacting portion exposed upon the inner surface thereof.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
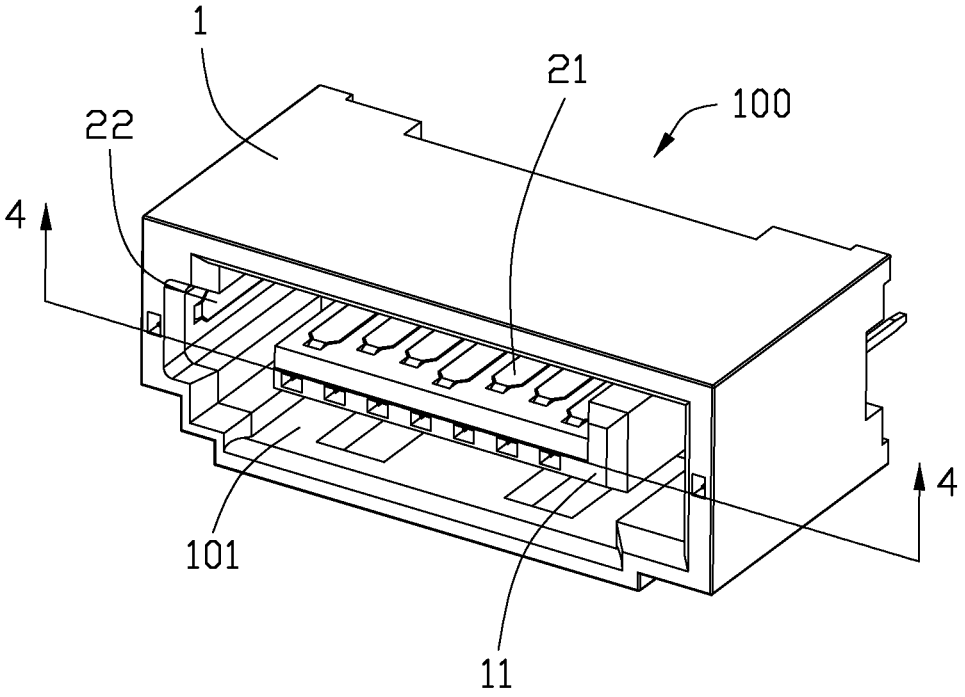
FIG. 1 is an assembled, perspective view of an electrical connector in accordance with the present invention.

Referring to FIG. 1, an electrical connector 100 includes an insulative housing 1, a plurality of first conductive terminals 21 mounted in the housing 1 for signal transmission, and a pair of second conductive terminals 22 retained in the housing 1 for different-voltage power transmission. The insulative housing 1 defines a mating or receiving cavity 101 running through a front face thereof and an L-shaped mating tongue 11 extending forwardly to dispose in the mating chamber. These components will be described in detail below.

Figure 2:
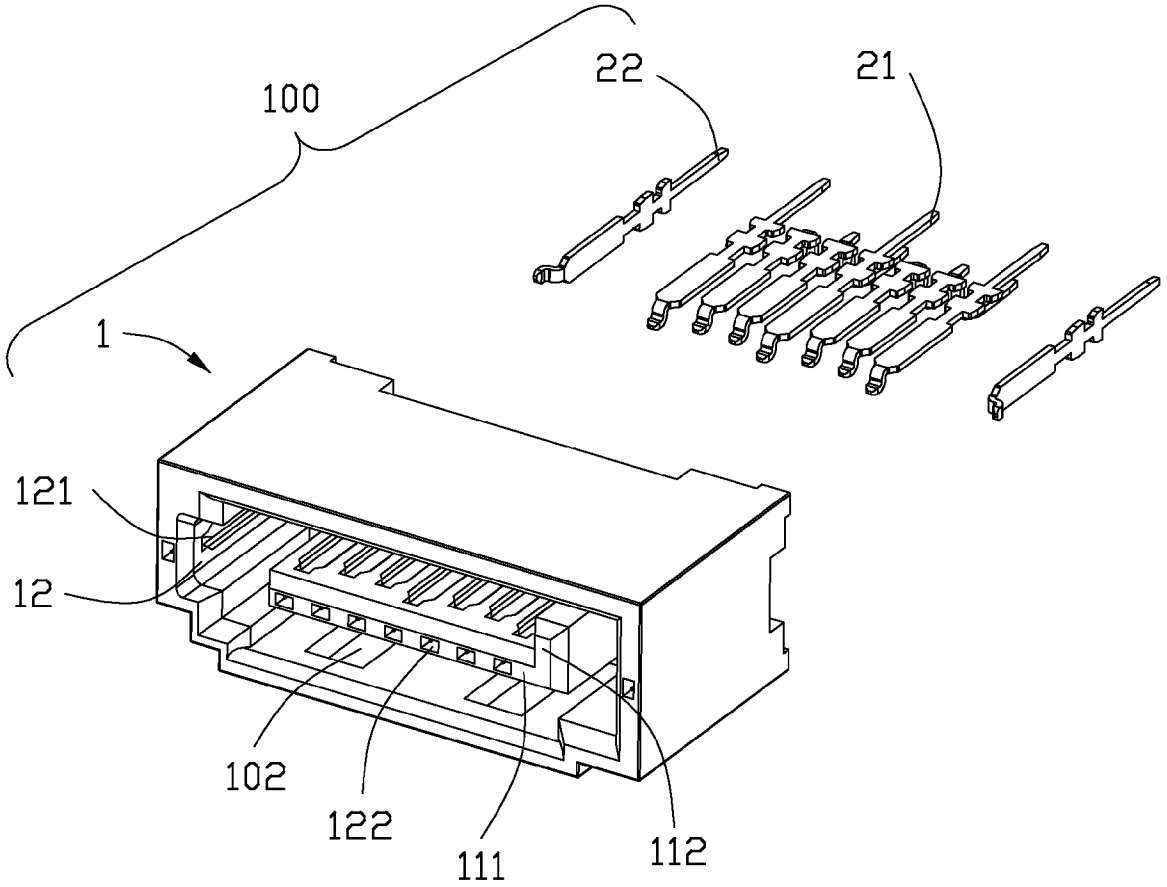
FIG. 2 is an exploded view of the electrical connector shown in FIG. 1.
Figure 3:
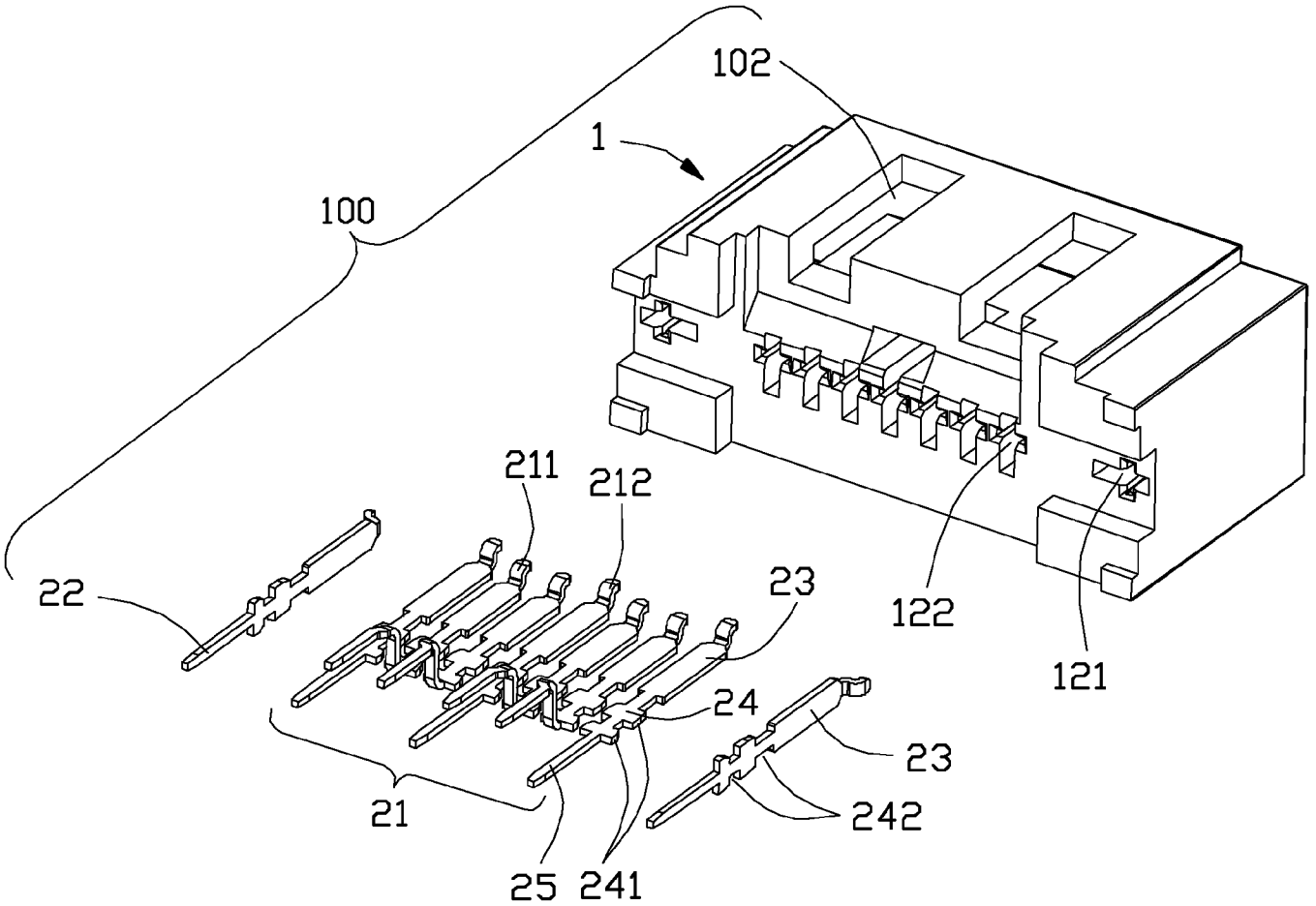
FIG. 3 is another exploded view of the electrical connector shown in FIG. 2.
Figure 4:
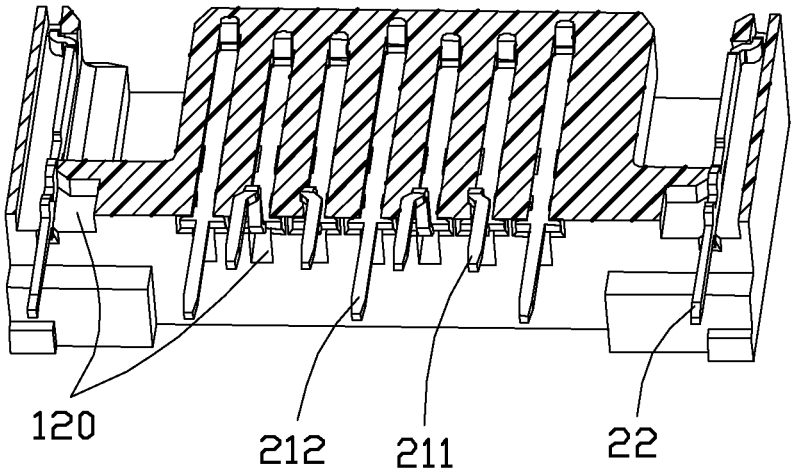
FIG. 4 is a cross sectional view of the electrical connector taken along line 4-4 in FIG. 1.

Referring to FIG. 2 and FIG. 3, the insulative housing 1 is configured as hexahedral shape and defines a mating frame having opposite top and bottom walls parallel to the mating tongue 11 and two sidewalls connecting with the top and bottom wall at two opposite ends thereof. The insulative housing 1 defines a pair of opening 102 running through the bottom wall for expediently molding of the insulative housing 1. The two sidewalls each has an inner surface 12 disposed in the mating cavity 101, the inner surface 12 spaces from the mating tongue 11 and faces to an end face of the mating tongue 11. The mating tongue shown as L-shaped includes a long side portion 111 and a short side portion 112 perpendicular to each other, the long side portion 111 is parallel to the opposite top and bottom walls. The short side portion 112 is parallel to the inner surface 12. The long side portion 111 of the mating tongue 11 defines a row of first terminal grooves or passageways 122 arranged on a mating face provided in the long side portion 111. The first conductive terminals 21 are accommodated in the first terminal grooves 122.

The first conductive terminals 21 are assembled into the first terminal grooves in a rear-to-front direction and provide stiff contacting portions 23 exposed upon the mating face. The second conductive terminals 22 are assembled into the second terminal grooves or passageways 121 of the sidewall in a rear-to-front direction and each provides a stiff contacting portion 23 exposed upon the inner surface 12. The first conductive terminals 21 are placed horizontally in the first terminal grooves 122. The second conductive terminals 22 are placed vertically in the second terminal grooves 121, and each stiff contacting portion 23 of the first conductive terminals 21 is perpendicular to a stiff contacting portion 23 of the second conductive terminals 22. The first conductive terminals 21 include two pairs of differential pairs 211 for signal transmission and three grounding terminals 212 located at two opposite sides of the differential pairs 211. The second conductive terminals 22 are used for different-voltage power transmission. The electrical connector not only meets the specification of SATA connectors, but also can achieve power transmission. The second conductive terminals 22 have the same structure with the three grounding terminals 212. The two pairs of differential pairs 211 are slightly different from the grounding terminals 212. As shown in FIG. 3, in a rear view, a cross-section of the first terminal groove 122 is similar to that of the second terminal groove 121 but with the ninety degree orientation difference. The first terminals 21 are essentially same with the second terminals 22, corresponding to the similar first terminal grooves 122 and second terminal grooves 121.

The first and second terminals 21, 22 each includes a retaining portion 24 retained in a rear wall of the insulative housing 1 and a connecting portion 25 extending out of the insulative housing 1. The retaining portion 24 includes two recesses 242 and two projections 241 spaced apart from each other for retaining the first and second terminals 21,22 respectively in the first and second terminal grooves 121,122 of the insulative housing firmly. The stiff contacting portions 23 and the retaining portions 24 of the first terminals are disposed in a same first plane, the connecting portions 25 of the grounding terminals of the first terminals 21 are disposed in the first plane, and the connecting portions 25 of the pairs of differential pairs 211 are disposed in a second plane parallel to the first plane. The connecting portions 25 of the two pairs of differential pairs bend away from the first plane to meet the high-frequency signal transmission requirements. The first and second terminal grooves 121,122 each defines an indentation 120 at a portion corresponding to the retaining portion 24 of the first and second conductive terminals 21, 22 respectively, which can make the first and second conductive terminals 21, 22 inserted into the terminal grooves 121, 122 easily and is benefit for the impedance of high-frequency.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

I claim:

1. An electrical connector comprising:

an insulative housing having a mating tongue and a mating frame formed around the mating tongue, the mating frame defining a mating cavity running through a front face thereof, and the mating tongue disposed in the mating cavity to be surrounded by the mating frame;

a plurality of first conductive terminals retained in the insulative housing and providing stiff contacting portions exposed upon a mating face of the mating tongue; and a pair of second conductive terminals retained in the insulative housing;

wherein the mating frame defines two opposite sidewalls perpendicular to the mating face, and each sidewall defines an inner surface facing to the mating tongue and spaced from the mating tongue, the pair of second conductive terminals each providing a stiff contacting portion exposed upon the inner surface thereof.

2. The electrical connector as claimed in claim 1, wherein the second conductive terminals are the power terminals used for different-voltage power transmission, the first conductive terminals include differential pairs for signal transmission and grounding terminals located at two opposite sides of the differential pairs.

3. The electrical connector as claimed in claim 2, wherein the first conductive terminals include two pairs of differential pairs and three grounding terminals, the power terminals have the same structure with the grounding terminals.

4. The electrical connector as claimed in claim 1, wherein each of the first and second conductive terminals includes a retaining portion retained in the insulative housing, the retaining portion includes two projections and two recesses spaced apart from each other for retaining the first and second terminals respectively in the insulative housing firmly.

5. The electrical connector as claimed in claim 4, wherein the stiff first contacting portions and the retaining portions of the first terminals are disposed in a same first plane, connecting portions of the grounding terminals of the first terminals are disposed in the first plane, and the connecting portions of the pairs of differential pairs are disposed in a second plane parallel to the first plane.

6. The electrical connector as claimed in claim 1, wherein the mating tongue is configured as an L-shaped and comprises a long side portion and a short side portion perpendicular to the long side portion, the short side portion is parallel to the inner surface, the mating face is provided on the long side portion.

7. The electrical connector as claimed in claim 6, wherein the long side portion of the mating tongue defines a row of first terminal grooves arranged on the mating face, the inner surface each defines a second terminal groove thereof, the first conductive terminals are accommodated in the first terminal grooves, and the second conductive terminals are accommodated in the second terminal grooves.

8. The electrical connector as claimed in claim 7, wherein the first conductive terminals are placed horizontally in the first terminal grooves, the second conductive terminals are placed vertically in the second terminal grooves, and the first contacting portion of the first conductive terminals are perpendicular to the second contacting portion of the second conductive terminals.

9. The electrical connector as claimed in claim 1, wherein the mating frame having opposite top and bottom walls parallel to the mating tongue and two sidewalls connecting with the top and bottom wall at two opposite ends thereof, the mating cavity is formed commonly by the top wall, the bottom wall and the two sidewalls.

10. The electrical connector as claimed in claim 9, wherein the insulative housing defines a pair of openings running through the bottom wall for expediently molding of the insulative housing.

11. An electrical connector comprising:

an insulative housing having a frame structure to define a receiving cavity with an asymmetrical contour in a front view, a mating tongue forwardly extending, along a front-to-back direction, in the receiving cavity with an L-shaped cross-section in a lying manner;

a plurality of contacts disposed in the housing with contacting sections exposed upon the mating tongue in a vertical direction perpendicular to said front-to-back direction;

a pair of power contacts disposed in the housing, and located by and spaced from two sides of the mating tongue along a transverse direction perpendicular to both said front-to-back direction and said vertical direction; wherein said housing defines a plurality of passageways to receive the corresponding contacts and power contacts, respectively, and each of said passageways receiving the contacts extends through a front face of the mating tongue while each of said passageways receiving the power contacts extends through a front face of said frame structure.

12. The electrical connector as claimed in claim 11, wherein both said contacts and said power contacts are of a flat manner without deflection, and said contacts and the power contacts are essentially same with each other in configuration.

13. The electrical connector as claimed in claim 12, wherein each of the contacts and each of the power contacts are arranged perpendicular to each other.

14. The electrical connector as claimed in claim 11, wherein said contacts include differential pairs and grounding contacts, and each of said contacts defines a retaining section behind the contacting section, and a connecting section behind the retaining section, the retaining sections of all said contacts and the connecting sections of said grounding contacts being commonly in a first plane while the connecting sections of said differential pairs being located in a second plane parallel to and spaced from said first plane.

15. An electrical connector comprising:

an insulative housing having a frame structure to define a receiving cavity with an asymmetrical contour in a front view, a mating tongue forwardly extending, along a front-to-back direction, in the receiving cavity with an L-shaped cross-section in a lying manner;

a plurality of contacts disposed in the housing with contacting sections exposed upon the mating tongue in a vertical direction perpendicular to said front-to-back direction;

a pair of power contacts disposed in the housing, and located by and spaced from two sides of the mating tongue along a transverse direction perpendicular to both said front-to-back direction and said vertical direction; wherein said housing defines a plurality of passageways to receive the corresponding contacts and power contacts, respectively, each of said passageways receiving the contacts defines a first cross configuration in a rear view, each of said passageways receiving the power contacts defining a second cross configuration, in the rear view, essentially same as the first cross configuration except in a different orientation with a ninety-degree difference.

16. The electrical connector as claimed in claim 15, wherein the power contacts and the contacts are essentially same with each other except with ninety-degree difference orientations.

17. The electrical connector as claimed in claim 15, wherein said contacts include differential pairs and grounding contacts, and each of said contacts defines a retaining section behind the contacting section, and a connecting section behind the retaining section, the retaining sections of all said contacts and the connecting sections of said grounding contacts being commonly in a first plane while the connecting sections of said differential pairs being located in a second plane parallel to and spaced from said first plane.

* * * * *